United States Patent [19]

Eriksen

[11] Patent Number: 4,494,475

[45] Date of Patent: Jan. 22, 1985

[54] SYSTEM FOR MOORING A FLOATING STRUCTURE

[75] Inventor: Tor Eriksen, Buoy, Norway

[73] Assignee: Moss Rosenberg Verft A/S, Jeloy, Norway

[21] Appl. No.: 438,031

[22] Filed: Nov. 1, 1982

Related U.S. Application Data

[63] Continuation of Ser. No. 116,846, Jan. 30, 1980, abandoned.

[30] Foreign Application Priority Data

Feb. 14, 1979 [NO] Norway ..... 790494

[51] Int. Cl.[3] ..... B63B 21/00

[52] U.S. Cl. ..... 114/230; 441/5

[58] Field of Search ..... 114/230; 441/3-5; 188/265, 312, 321, 322; 267/64 R; 137/615

[56] References Cited

U.S. PATENT DOCUMENTS

| | | | |
|---|---|---|---|
| 3,062,330 | 11/1962 | Lyon | 267/64 R |
| 3,131,921 | 5/1964 | Karbowniczek | 188/312 |
| 3,608,577 | 9/1971 | Blanchard | 137/615 |
| 3,783,816 | 1/1974 | de Chassy | 441/3 |
| 4,052,090 | 10/1977 | Stafford | 285/61 |
| 4,144,831 | 3/1979 | Heydolph | 114/230 |
| 4,176,615 | 12/1979 | Reid et al. | 441/5 |
| 4,206,717 | 6/1980 | Okuda | 114/230 |

*Primary Examiner*—Trygve M. Blix
*Assistant Examiner*—Stephen P. Avila
*Attorney, Agent, or Firm*—Pasquale A. Razzano

[57] ABSTRACT

Mooring systems for floating vessels positioned offshore. A rigid column extends from the sea floor and provides a single-point mooring for a barge or other floating structure which includes facilities for storing oil or liquified gases. The barge may also include facilities for liquefying gases. A fluid line for oil or gas extends from below the water line inside the vertical column to the mooring point above the water line. A pair of mooring arms is pivotally attached to a table pivoted on the mooring point, and the arms diverge with their other ends attached to the barge at zones spaced from each other. The arms are extensible and each of them has a compensator which tends to hold each arm to a predetermined length. Each compensator also restrains the rate of movement during extension and contraction of its arm. A fluid-flow line extends from the mooring point to the barge with flexible interconnections between the fluid-flow lines above the water line. A third arm is provided in certain embodiments of the invention and a fluid line is provided from a sea flow upwardly through the vertical column and then along one of the arms to the barge or other floating structure.

18 Claims, 9 Drawing Figures

SYSTEM FOR MOORING A FLOATING STRUCTURE

CROSS REFERENCES TO RELATED APPLICATIONS

This is a continuation of application Ser. No. 116,846 filed Jan. 30, 1980, now abandoned.

BACKGROUND OF THE INVENTION

1. Field of the Invention

This invention relates to mooring systems for ships, barges and other floating structures which are referred to herein as "vessels". The invention relates particularly to mooring systems for vessels which receive or discharge fluid cargo while they are moored, for example, barges and ships which receive or discharge liquid or gas, such as LNG (liquified natural gas), LPG (liquified petroleum gas), oil or fuel gas.

An object of this invention is to provide mooring systems of the above type which are free of certain of the deficiencies of the prior art. A further object is to provide such systems which can be used for barges which are stationed at a particular location for accumulating or storing LNG. These and other objects will be in part obvious and in part pointed out below.

2. Description of the Prior Art

The increased importance of LNG has resulted in the development of systems for mooring vessels such as barges where the gas is received and liquified, and such installations which provide regasification facilities. A publication of Moss Rosenberg Verft A/S entitled "The Moss Rosenberg Marine LNG System", September 1978, discloses a marine LNG system with a mooring arrangement for barges having LNG storage tanks, liquefaction facilities for gas, and facilities for transferring the gas to the barge and the LNG cargo to tankers. A hinged yoke on the barge is attached to an upright leg or "tension leg" which is anchored to the sea bed and which has a large buoyancy container which tends to urge the tension leg toward an upright position. The tension leg is hinged at its bottom end to the anchoring means and at its top end to the yoke. Transfer lines for fluid cargo extend down the tension leg and have movable connecting structures or couplings which permit the lines extending from the barge to have free movement with respect to stationary lines extending from the shore or elsewhere to the anchoring position. Those connections or couplings are below the surface of the water, and that prevents ready inspection and servicing. That mooring system may also be subject to damage by collision, for example, by a tanker moving to or from a position alongside the barge.

A similar mooring system is disclosed in "OCEAN INDUSTRY", November 1978, and is identified as incorporating a special triaxial swivel universal joint in the piping of the cargo transfer lines. That system also has an underwater upright leg which is connected by a universal joint at its lower end to anchoring means on the sea bed. In each of those systems, the upright leg moves about its lower end, and the barge moored to it can swing generally around the mooring point formed by the pivot provided by the attachment of the bottom end of the upright leg to the anchor.

With both of the systems just discussed, the general approach is to provide a riser projecting generally upwardly from the anchor and pivoted at its bottom end, and to a mooring yoke. The pivoting action at the sea bottom can create problems because of the rotatable connections in the line or lines for transferring liquid or gas to or from the moored vessel. Also, the upright leg is often completely submerged so that its location cannot always be determined by observation from a vessel approaching or passing the barge which is moored. It is a further object of the present invention to provide mooring systems which overcome difficulties which are present with prior mooring systems such as those discussed above.

SUMMARY OF THE INVENTION

In accordance with the present invention, a mooring system for vessels is provided which includes a rigid anchor structure which is securely mounted on the sea floor and which provides a stationary mooring point above the water line. Fluid cargo transfer lines extend along the sea floor to the mooring base from the shore or from an off-shore source or storage facility. The cargo lines extend upwardly through the anchor structure to the mooring point above the water line. There are no underwater movable connections in the fluid flow path. The anchor ends of the mooring arms are connected to the top of the anchor structure by separate hinge or pivot structures. Other important features include the normal positioning of the moored vessel in a predetermined relationship with respect to the single mooring point.

BRIEF DESCRIPTION OF THE DRAWINGS

Referring now to the drawings.

DESCRIPTION OF THE PREFERRED EMBODIMENT

Figure 1:
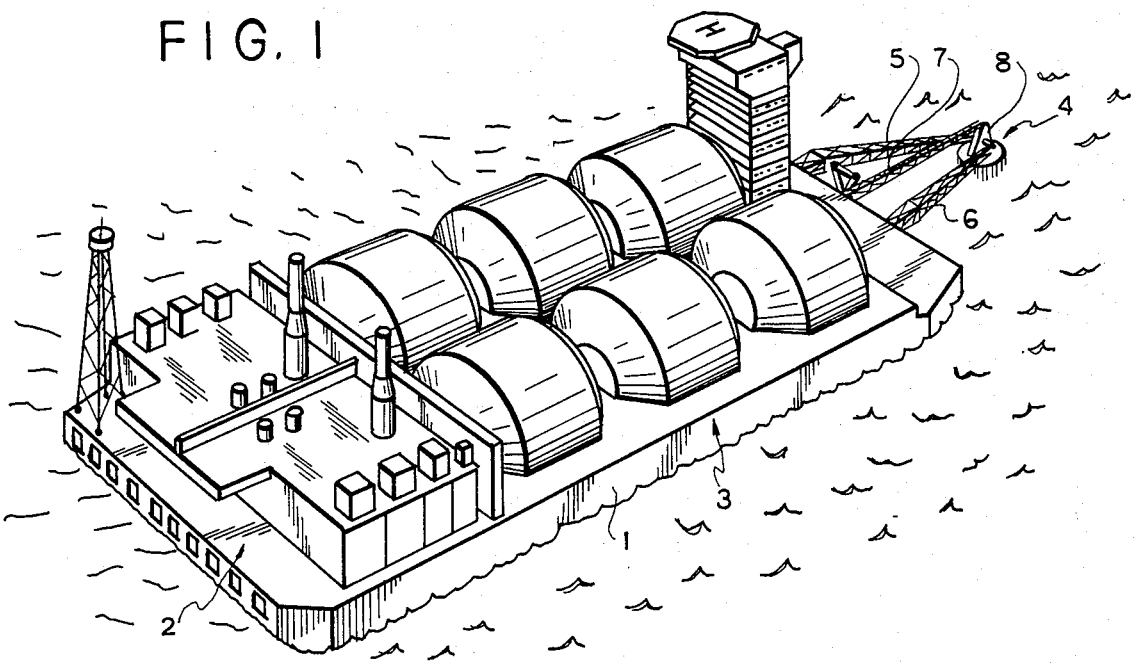
FIG. 1 is a somewhat schematic perspective view of a floating structure and a mooring system constituting one embodiment of the invention.
Figure 2:
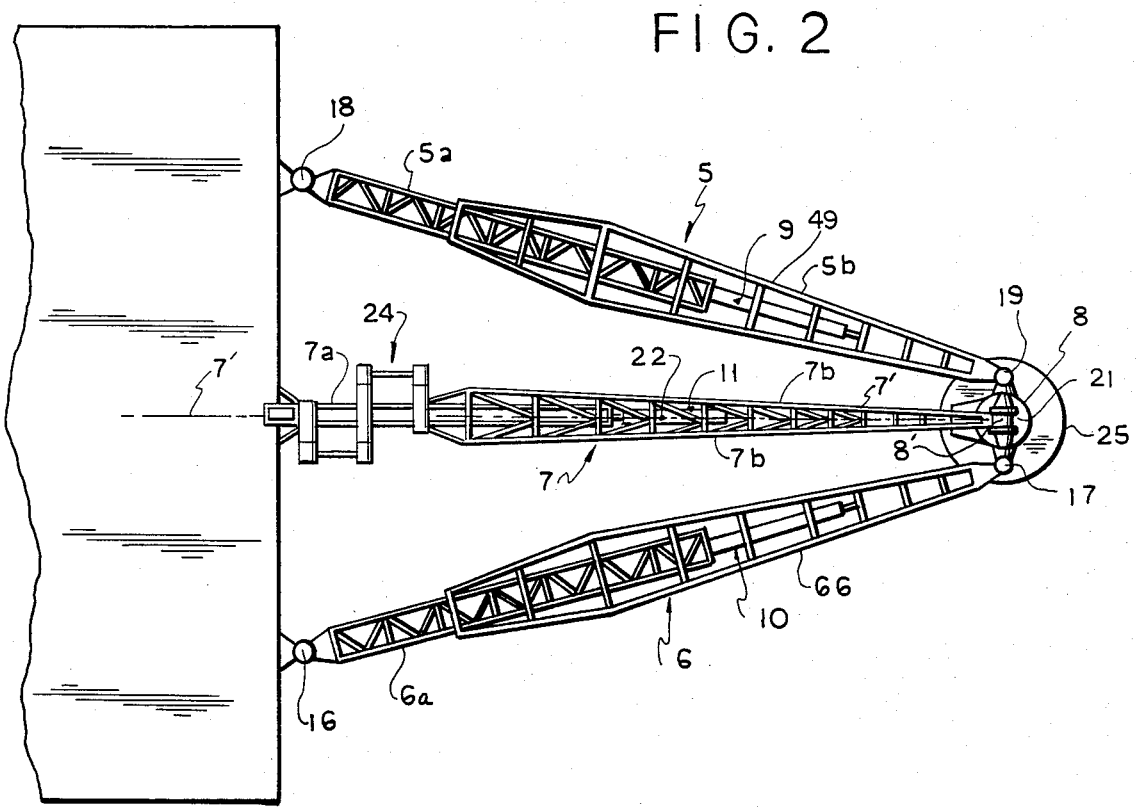
FIG. 2 is a plan view of the mooring system of FIG. 1.

Referring to FIG. 1 of the drawings, a barge 1 has built upon it a gas treatment plant 2 and an LNG storage plant 3. Barge 1 is moored by a mooring system which includes an anchor structure 4 formed by a rigid column 4' of concrete (see FIG. 3) which is fixed to the sea floor rock, and the base of which is surrounded by a layer of mud 27. Column 4' projects above the surface of the water and is of substantial weight and size. Column 4' can be fixed to a concrete slab, and there may be no mud around the column. As shown best in FIG. 2, three telescoped extensible arms 5, 6 and 7 are connected to the top of column 4' and to barge 1. Each of the arms is formed by two arm sections which telescope together to provide the extensible characteristics of the arms, arm sections 5*a*, 6*a* and 7*a* being connected to the end 1*a* of barge 1, and arm sections 5*b*, 6*b* and 7*b* being connected to the anchor structure 4. The connections between arm sections 5*a* and 6*a* and barge 1 are by ball joints 18 and 16, respectively. Arms sections 5*a*, 6*a* and 7*a* are connected to the respective arm sections 5*b*, 6*b* and 7*b* by compensators 9, 10 and 11, respectively. The connections between arm sections 5*b* and 6*b* and the anchor structure 4 are through a rotatable table 8 (see also FIG. 4) which is mounted on a center pivot construction (not shown) with the vertical axis 8' of column 4'. That axis constitutes the single mooring point upon which barge 1 is moored. Arm sections 5*b* and 6*b* are connected to table 8 by ball joints 19 and 17, respectively. Arms section 7*a* is connected to barge 1 by ball joint 20 (FIG. 4), and arm section 7*b* is connected to the top of table 8 by a horizontal axis hinge 21. It is thus seen that when barge 1 moves in any of its linear or rotational directions or in several motion modes simultaneously, so that its end 1*a* moves, the attached ends of the arms are permitted to swing around pivots with respect to the barge.

Barge 1 and arms 5, 6 and 7 (FIG. 2) are shown in the drawings in the "desired attitude" or neutral position in which the vertical longitudinal center plane of the barge, as represented by the center line 1', extends along a radius line 7' from axis 8' of column 4', and none of the compensators 9, 10, 11 is extended or further telescoped. The vertical longitudinal center plane of the barge extends through axis 8', and the barge is a fixed distance from the mooring point when the barge is in its neutral horizontal position. Each of the compensators is enclosed within the arm sections of its arm and it operates somewhat in the manner of commonly-known shock absorbers to limit the rate of the relative movement between the arm sections from the neutral position where the arms are being extended or further telescoped. Each of the compensators also limits the extension of its arm and provides a force urging the arm sections toward the neutral or home position. Each of the compensators 9, 10 and 11 acts to hold its arm 5, 6 and 7, respectively, in that neutral position until a force greater than a predetermined value is exerted upon the arm to draw the arm sections apart or to telescope them further. The compensator then produces a force urging the return of the arm to its neutral position when the arm sections have been moved from that position. Each of the compensators also restrains or limits the rate of movement of the arm sections from and to the partially-telescoped neutral position.

When forces greater than the predetermined value act to swing barge 1 out of the neutral position shown with respect to radius line 7', two or all of arms 5, 6 and 7 are moved from the neutral position against the action of their compensators, and the rate of such swinging movement of the barge is restricted to an acceptable value by the compensators. With the barge moored as shown, if forces act to turn the barge counterclockwise, arm sections 5*a*, 5*b* will be extended, or arms sections 6*a*, 6*b* will be further telescoped, or there can be a combination of both of those actions, and the rate of each such movement is controlled. Contrarywise, clockwise movement of the barge either draws arm sections 6*a*, 6*b* apart or telescopes arm sections 5*a*, 5*b* apart, each at a controlled rate, or there can be a combination of both of those sections. The amount of telescoping or expanding of arm 7 depends upon the directions and and magnitudes of forces and the effective resistance exerted by arms 5 and 6 and their compensators. For example, if one of arms 5 or 6 remains in its neutral condition, and the barge turns clockwise or counterclockwise, arm 7 will expand or telescope substantially one-half of the change in the length of the other arm 6 or 5. Arms sections 7*a* and 7*b* are telescoped or extended when the vessel is moved, respectively, directly toward or directly away from the mooring point. Also, arm 7 always maintains a length which is of the order of the difference between its length in the neutral position and the averages of the amounts by which arms 5 and 6 have moved from their respective neutral positions. That is, arm 7 can remain in its neutral position when the vessel swings and one of arms 5 and 6 telescopies and the other extends the same amount. The angles between the arms change when barge 1 moves from the desired attitude either by turning or by moving toward or away from mooring axis 8', and the arms are free to pivot at their ball joints. When the forces acting on barge 1 to move it from its home position are reduced, the compensators draw the barge back to the neutral position or "desired attitude". It should be noted that barge 1 can swing around axis 8' while maintaining the desired orientation with respect to that axis. Although a turning motion of barge 1 with respect to radius line 7' is described above, it must be understood that the compensators also allow and restrain (control) motions of the barge in all six of its degrees of motion (three rotations and three lineal, tri-axial motions). It is thus seen that the arms permit a wide range of relative movement of the vessel so that the vessel can accommodate itself to changing conditions of wind, wave action and current flow.

Figure 9:
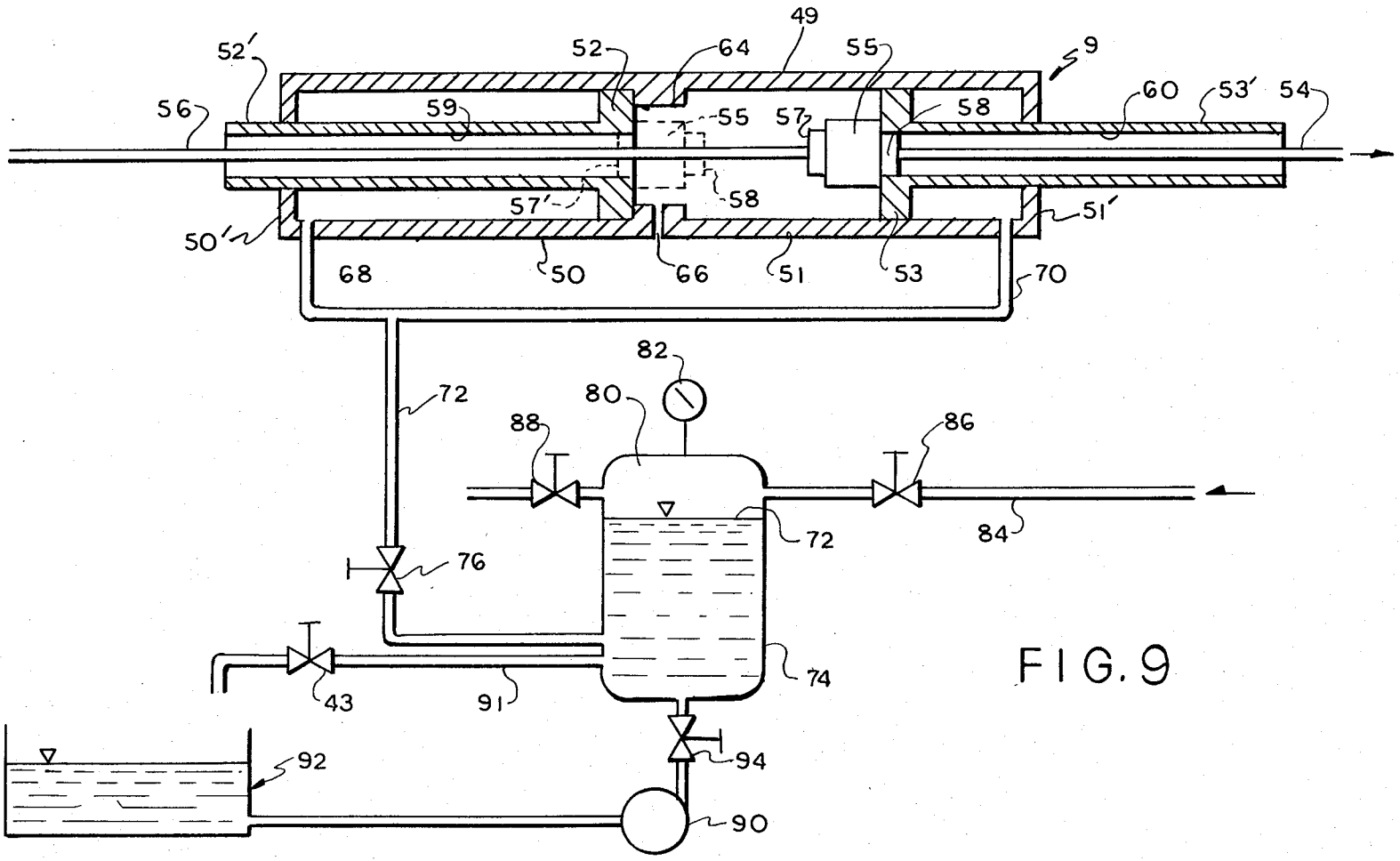

Referring now to FIG. 9 of the drawings, compensator 9 has a double cylinder 49 formed by cylinders 50 and 51 which are interconnected in tandem and have pistons 52 and 53, respectively. Each of the pistons has an extended sleeve portion 52' and 53', respectively, which extend through sealed bores in the respective cylinder heads 50' and 51'. The is a common piston rod assembly comprising a piston rod 54, a centrally positioned cylindrical impeller block 55 and a piston rod 56. When the arm sections are in the neutral position, block 55 is positioned as shown in broken lines with its reduced end portions 57 and 58 snugly received in the respective central bores 59 and 60 of pistons 52 and 53. Double cylinder 49 is mounted upon arm section 5*a* and piston rod 54 is connected to arm section 5*b*. When the arm sections are in their neutral position, impeller block 55 and piston 53 are in the broken line position. When the arm sections are extended from the neutral position, piston rod 54 is pulled to the right, and impeller block 55 moves away from piston 52 and pulls piston 53 to the right in cylinder 51 toward the position shown in the drawing. Piston 52 is held in the position shown. When the arm sections are telescoped from the neutral position, piston rod 54 is moved to the left and impeller block 55 moves away from piston 53 and pushes piston 52 to the left in cylinder 50 and piston 53 remains in the broken line position. At the juncture of cylinders 50 and 51 there is a stop flange 64 which projects radially inwardly from the cylinder walls, and against which pistons 52 and 53 rest when the arms are in the neutral position. A vent hole 66 through the cylinder wall permits air to enter and to be discharged from the space between the pistons. Hydraulic liquid lines 68 and 70 are connected to the opposite ends of cylinders 50 and 52, and a common line 72 extends from the juncture of lines 68 and 70 to an accumulator tank 74 for the liquid which is oil. An adjustable restricter valve 76 is positioned in line 72 and can be adjusted to control the rate of flow of oil between tank 74 and the cylinders. Tank 74 has a body of compressed air in the space 80 above the level 78 of the body of oil in the tank, and a pressure gauge 82 is connected to the top of the tank. Compressed air is supplied to space 80 in the tank through a line 84 having a shut-off valve 86 therein. An air discharge line is connected to space 80, and has a shut-off valve 88 therein. Oil is supplied to tank 74 by a pump 90 from an oil reservoir 92, and a shut-off valve 94 is closed when the desired quantity of liquid has been supplied to the tank and the pump is stopped. An oil drain line 91 extends from tank 74 to oil reservoir 92, and has a shut-off valve 93.

The predetermined air pressure in space 80 acts through the body of liquid in tank 74 and lines 72, 68 and 70 provide substantially that pressure in cylinders 50 and 51. Hence, each of the pistons is urged toward the center of the double cylinder against flange 64. That predetermined liquid pressure determines the force which must be overcome to move arm sections 5*a* and 5*b* from their neutral position. That force of the liquid also acts to return the arms to the neutral position when the forces exerted by the vessel are reduced.

The rate of flow of liquid through valve 76 controls the rate at which one of pistons 52 and 53 can be moved away from or toward the neutral position. In this embodiment, the limit on the rate of movement is the same when the arm sections are being telescoped as when they are being extended. The invention contemplates that separate liquid lines with separate control valves can be provided between tank 74 and the respective cylinders 50 and 51. It is also contemplated that the movement of either of the pistons away from the neutral position can be made different from the return movement of that piston to the neutral position. That may be accomplished by separate one-way control valves in parallel lines with the flow to the cylinder through one line and from the cylinder through the other line. It should be noted that piston rod 56 has no function in the construction shown.

As indicated above, the compensators are identical, each biasing its arm sections to the neutral position and limiting the rate of relative movement between the arm sections. The "Moss Rosenberg System" and that disclosed in the "Ocean Industry" article have buoyancy chambers and other components which are positioned in the water and which act to restrain the rate of movement of the vessel. The compensators of the present invention act directly on their arm sections, and the limitation on the rate of movement is inherent in the arm assembly. The arm sections and their connections with the vessel and the mooring point are not subjected to excessive forces when the vessel is being moved to the neutral position. That is because the rate of such movement is limited by the rate of flow of the hydraulic fluid to the cylinder of the compensator (or compensators). That flow is under the pressure of the air in the accumulator. The action is somewhat the same as that of a spring positioned to act on the piston, except that additional advantageous features are provided. When the arm sections are being returned to the neutral position, the force is sufficient to effect the return movement, but the rate of movement is reliably controlled by the rate at which the hydraulic fluid is permitted to flow to the cylinder. Hence, the arm exerts the desired force between the mooring point and the vessel with there being a "time factor" which is determined by the rate of flow of the hydraulic fluid to the cylinder.

Figure 3:
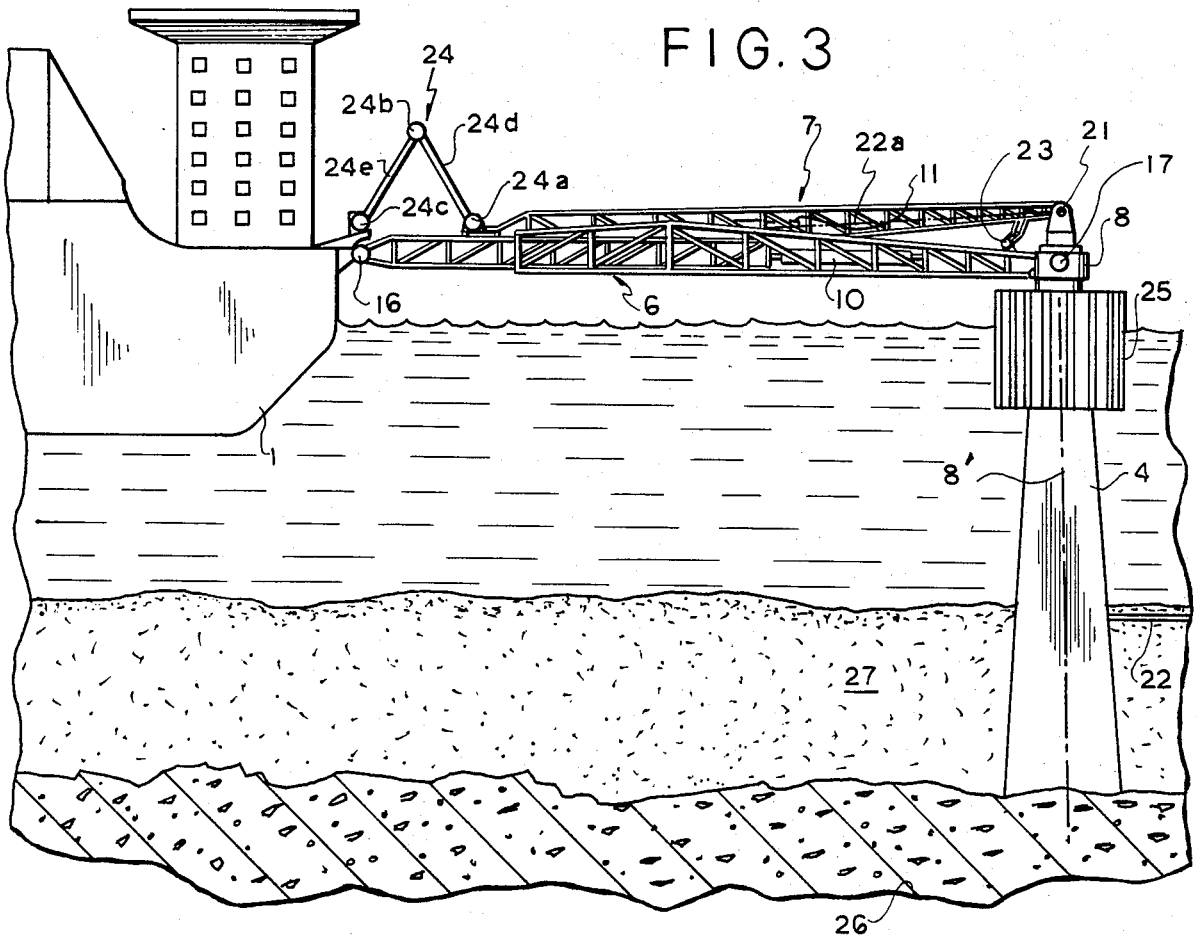
FIG. 3 is a somewhat schematic side view of the mooring system of FIG. 2.
Figure 4:
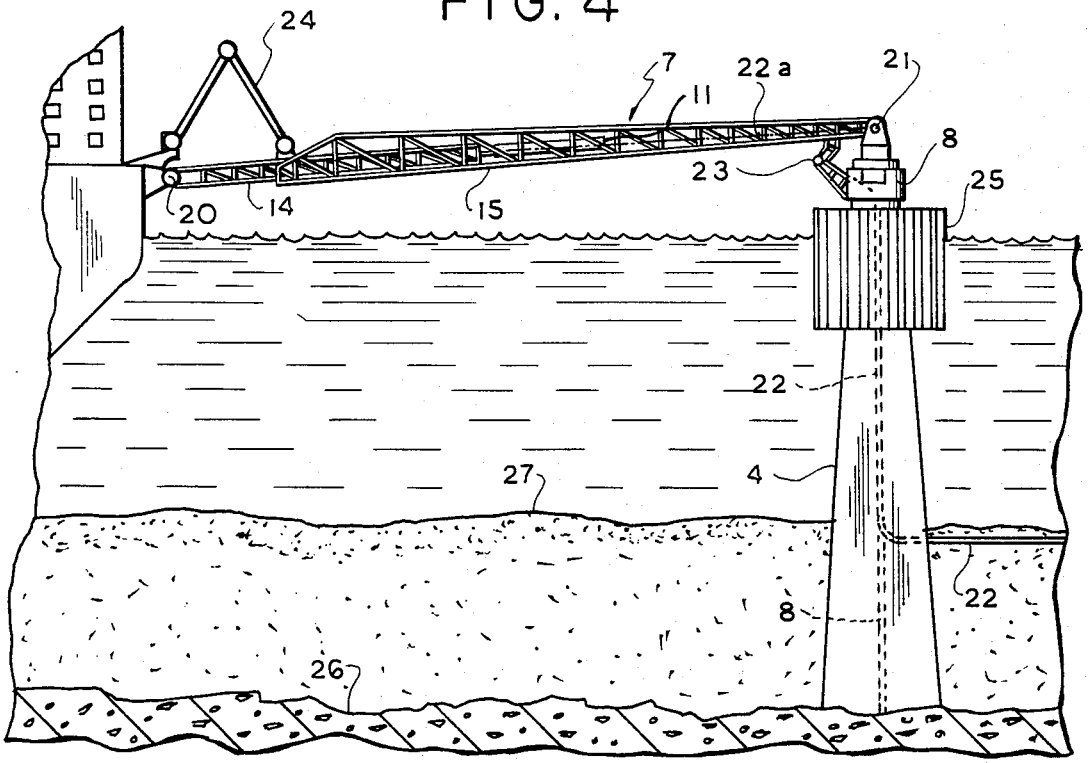
FIG. 4 is a side view of the central arm in the mooring system of FIGS. 1 to 3.

Referring to FIG. 3, a fluid line 22 extends from a shore station or from another source or storage facility for the fluid cargo which can be a gas or a liquid. Line 22 extends upwardly within column 4' to a movable connection 23 and to a line 22*a* which extends along arm 7 toward the barge. Line 22*a* is connected through movable pipe connection 24*a* to one end of a pipe assembly connection 24. Pipe assembly connection 24 is formed by two pipe sections 24*d* and 24*e* which are interconnected by a movable connection 24*b*. Section 24*d* is connected through connection 24*a* to arm section 7*a* (See FIG. 1), and section 24*e* is connected through a movable connection 24*c* to a line on the barge. When barge 1 moves from the position shown so as to extend arm 7, the pipe sections swing downwardly from the position shown (FIG. 3), and at all times provide a continuous flow path while permitting arm 7 to contract or to extend to its maximum length subject to the action of compensator 11.

A fender 25 is mounted upon the top of column 4 and provides protection from damage to the column by collision from vessels. Arms 5 and 6 also provide collision protection in that the barge is secured to column 4 even if there is serious damage to one or both of the arms. If there is serious damage to either or both of arms 5 and 6, arm 7 maintains a secure connection which can cooperate with either of the arms or can act alone within certain limits. The movable connections for the fluid flow path are of known types. The compensators can be adjusted to provide the desired range of resistance to movement of the barge from the desired orientation, and also to provide the desired maximum rate of movement of the barge for a given unbalanced force causing the movement.

Figure 5:
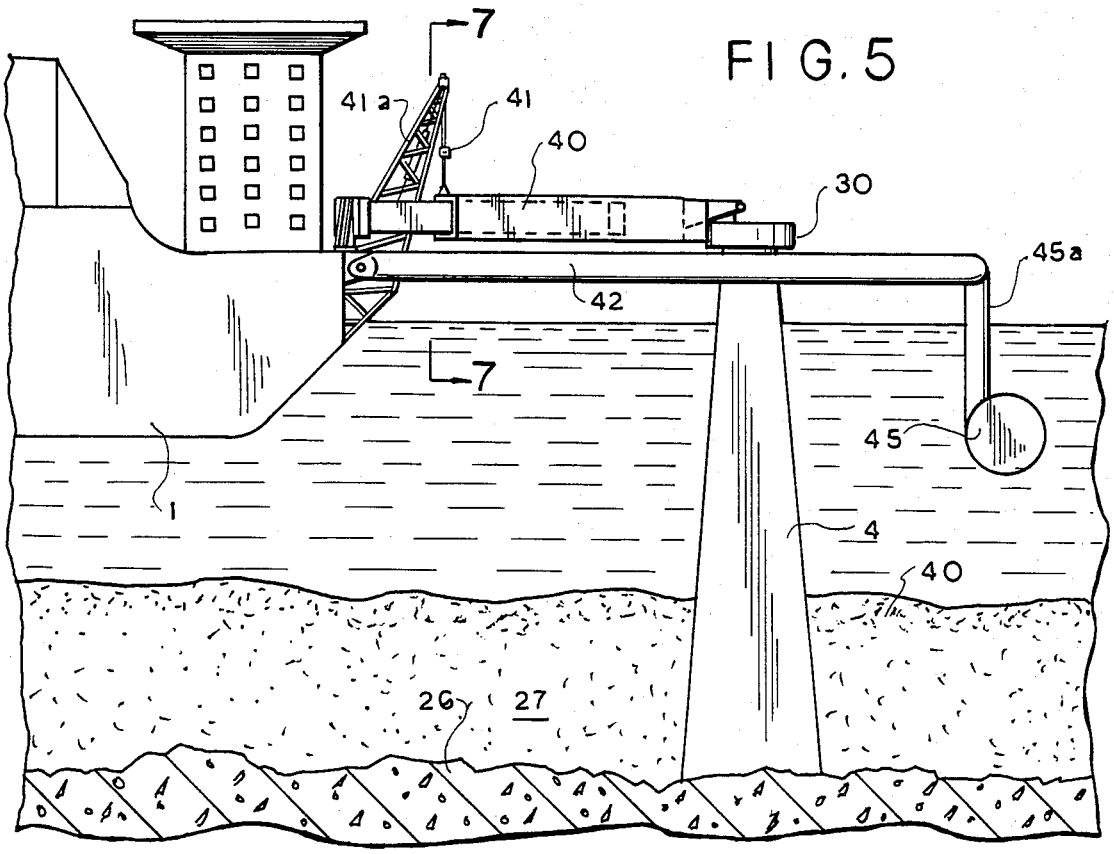
FIGS. 5 and 6 are views similar to FIGS. 3 and 2, respectively, but showing another embodiment of the invention.
Figure 6:
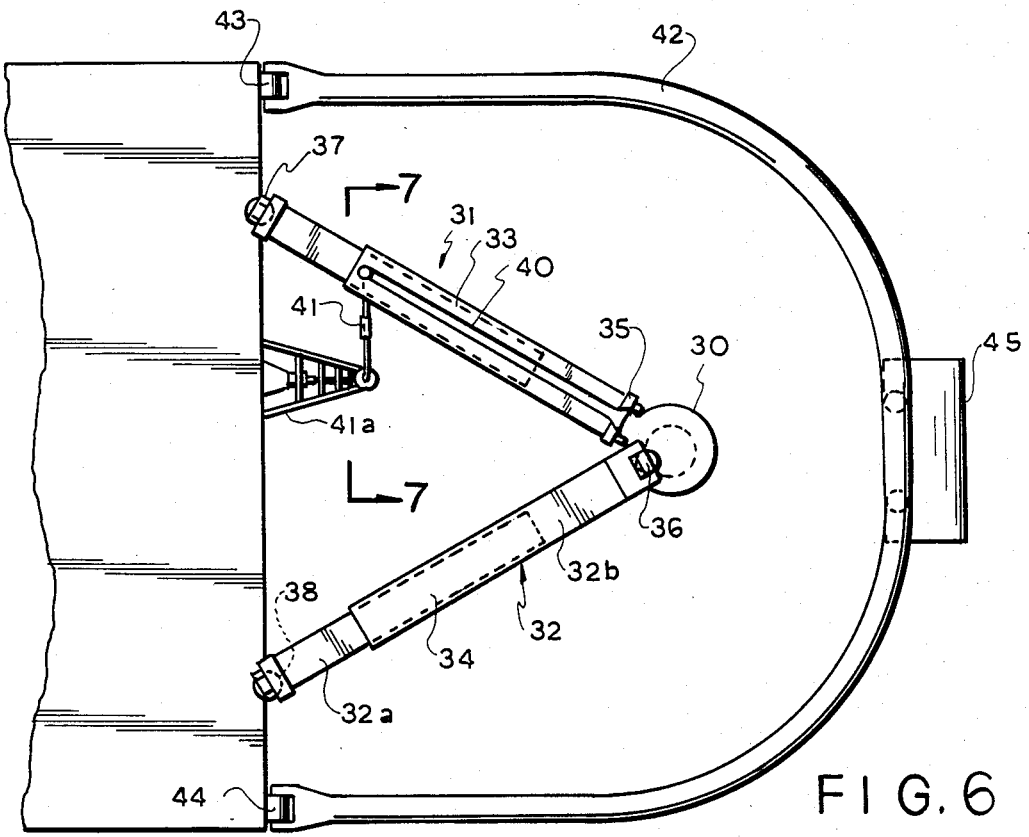
Figure 7:
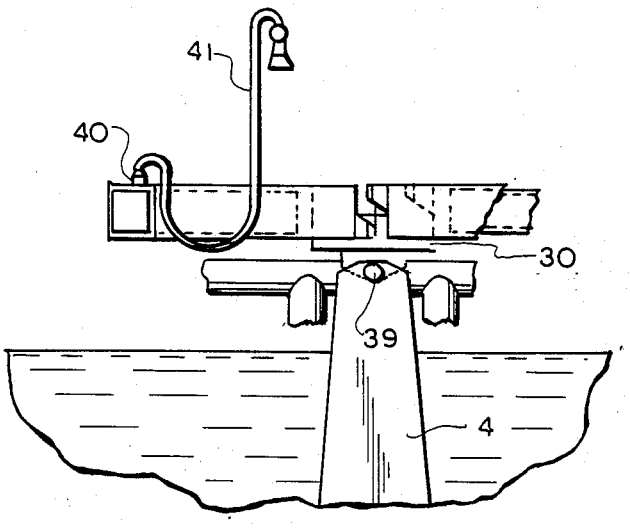
FIG. 7 is a vertical section on the line 7—7 of FIG. 6.

The embodiment of the invention shown in FIGS. 5, 6 and 7, is the same as that of FIGS. 1 to 4, except as is pointed out below. There are only two mooring arms 31 and 32 which connect barge 1 to column 4, the center arm being omitted. Also, fender 42 is in the shape of an open "C", connected at its ends to barge 1 by horizontal axis hinges 43 and 44. A semi-submersible buoyancy tank 45 is mounted at the center of fender 42 by two vertical arms 45*a*. Tank 45 supports the fender in the horizontal position above the water line, as shown. Referring to FIG. 6, arms 31 and 32 have arm sections 31*a* and 32*a* connected to the barge by universal joints 37 and 38, respectively. Arm section 31*b* is connected to a rotatable table 30 by a horizontal axis hinge 35, and arm section 32*b* is connected to table 30 by a universal joint 36. A gas or liquid cargo transfer line 40 (FIG. 5) corresponds to line 22 in FIGS. 2 to 4, and extends upwardly within column 4 to a movable connection adjacent table 30. That movable connection provides the fluid flow path to a line 40' which extends along arm section 31*b* and is connected at its other end to a line 41 which extends to the barge. Line 41 is supported by a tower structure 41*a* (FIG. 5) mounted on the barge and extending upwardly and outwardly. Fender 42 is swung upwardly above the level shown to permit the barge to move to or from column 4.

Referring now to FIG. 7, table 30 is rockably mounted upon the top of column 4 by a horizontal axis hinge 39. Hence, table 30 can rock with respect to the column, and that provides additional freedom of movement for arms 31 and 32 and the barge is still securely moored.

Figure 8:
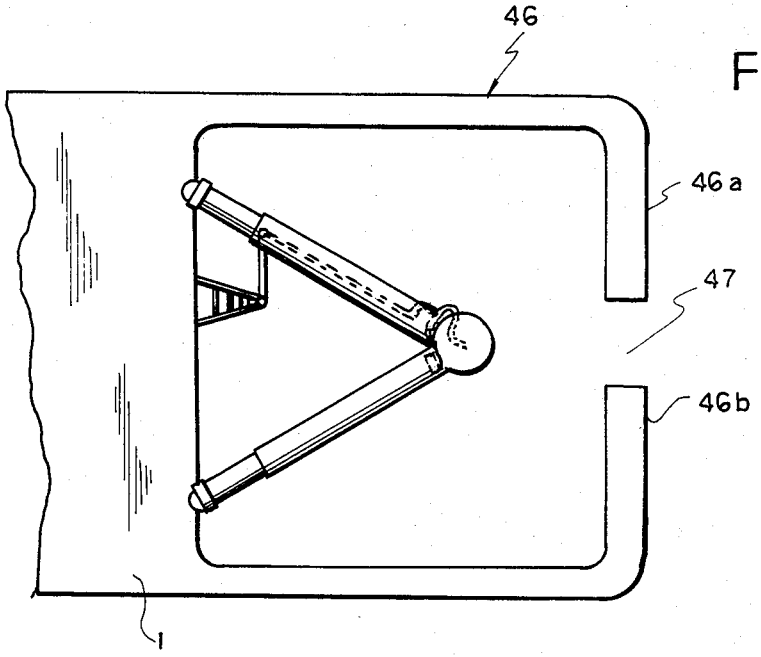
FIG. 8 is a view similar to FIG. 6 and showing a modified form of the embodiment of FIGS. 5 and 6; and, FIG. 9 is a schematic view of one of the three compensators for the mooring arms of the embodiments of FIGS. 1 to 8.

The embodiment of FIG. 8 differs from that of FIGS. 5, 6 and 7, only in that fender 42 is replaced by a rigid fender 46 extending from the barge. Fender 46 comprises two arms which extend in parallel relationship from the barge, with end portions 46*a* and 46*b* which extend at right angles toward each other. The ends of portions 46*a* and 46*b* are separated by a gap 47 which permits the barge to approach column 4 and pass the ends of the fender arms upon opposite sides of the column.

It is thus seen that single-point mooring arrangements are provided which are superior to those of the prior art. All three of the embodiments incorporate the extensible arms which converge toward the mooring point and which include compensators for urging the barge toward the desired attitude with respect to the mooring point. The rate of movement from and to that desired attitude is controlled by the compensators. The system promotes a stable relationship between the barge and a tanker moored alongside. As discussed above, the fluid cargo lines have movable couplings or connections only above the surface of the water. That permits inspection and servicing of the couplings and it also permits the ready changing of the couplings to provide for multiple lines when that is desirable.

The compensators are so constructed and arranged as to prevent objectionable surging or cyclic movements of barge 1. Each compensator operates to urge its arm to the predetermined length in which the barge is in the desired orientation, as discussed above, and the rates of expansion and contraction of the arm are controlled so as to dampen any tendency for vibration or relative cyclic movement of the arm sections. It should be noted that barge 1 has six "degrees of motion", that is, three linear tri-axial motions and three rotational motions. The mooring system of the present invention restrains those various movements while urging barge 1 toward the desired "home" position at all times.

The term "desired attitude" has been discussed above and is the home portion or neutral position of barge 1 or another floating structure which is moored to column 4. It is understood that the floating structure can swing around the mooring axis formed by column 4, as illustrated, while maintaining the desired attitude as discussed above. In each embodiment, the fender is an energy-absorbing construction. Hence, the fender acts to stop a floating vessel which collides with it. The mooring arms also act as energy-absorbing constructions when they are involved in a collision.

It is understood that modifications can be made in the illustrative embodiment of the invention and that there may be other embodiments all within the scope of the claims.

What is claimed is:

1. A single-point mooring system for a floating structure comprising, the combination of, a fixed column supported on the sea floor and projecting upwardly, mooring means rotatably mounted on said column to define a fixed mooring point above the water level, and means for attaching a floating structure to said mooring means at a predetermined distance therefrom while permitting said distance to increase or decrease; said attaching means comprising a pair of telescopic mooring arms each of which has a pair of telescoping arm members and a neutral predetermined intermediate length and a maximum extended and minimum collapsed length whereby its effective length may be increased or decreased from said neutral predetermined intermediate length without substantially impairing its structural stability, a pair of compensator means separate from and operatively associated respectively with said arm members of each of said mooring arms for urging their associated arm members to the neutral predetermined intermediate length of the mooring arms while permitting them to be extended or telescoped from said neutral predetermined intermediate length against predetermined forces, each of said compensator means comprising a hydraulic piston and cylinder assembly operatively connected between the arm members of their associated mooring arms; means for separately pivotally attaching one end of each of said arms to said mooring means whereby said arms rotate with said mooring means about a common vertical axis at said mooring point, and separate means for pivotally connecting the other end of each of said arms directly to a floating structure at predetermined distances from each other, whereby said compensator means act through said arms to urge said floating structure toward a desired neutral attitude with respect to said mooring point while permitting said floating structure to move from said desired neutral attitude towards or away from said mooring structure while returning said floating structure to said neutral attitude when the forces moving said floating structure therefrom have been discontinued; said floating structure being free to swing around said vertical axis at said fixed mooring point irrespective of whether or not it is in said neutral attitude but it is urged continuously to said neutral attitude by the action of said compensators.

2. In a system for mooring a floating structure offshore in a body of water, the combination of, a rigid stationary column which is fixed to the bed at the bottom of the water and which projects upwardly therefrom, a single point mooring means rotatably mounted upon said column above the water level and providing a vertical mooring axis, two telescopic arms each formed of a pair of telescopically engaged arm members and having a predetermined normal intermediate length between a maximum extended length and a minimum collapsed length, means for separately pivotally connecting one end of each of said arms to said mooring means with said arms diverging from each other towards their opposite ends whereby said arms rotate with said mooring means about said vertical axis, separate means for independently pivotally connecting said opposite ends of each of said arms directly to said floating structure, and compensator means separate from and operatively associated with the telescopic arm members of said mooring arms for exerting compensator forces on their associated arms urging the arms toward their predetermined normal intermediate lengths while permitting the length of each arm to be increased or decreased from said normal length by forces which are opposite to and greater than the compensator forces, each of said compensator means comprising a hydraulic piston and cylinder assembly operatively connected between the arm members of the associated mooring arms; said mooring arms constituting a connection between said mooring means and said floating structure whereby said arms and the respective compensators urge said floating structure to a predetermined desired intermediate attitude with respect to said mooring means when said compensator forces are greater than any forces acting in opposition thereto, and whereby said floating structure can move from said desired intermediate attitude upon application of external forces tending to expand or compress said arms, and is free to swing around said mooring axis irrespective of the lengths of said arms and irrespective as to whether or not said floating structure is in said desired intermediate attitude, said systems being effective constantly to maintain said floating vessel in said desired intermediate attitude with respect to said axis whenever said compensator forces are greater than oppositely-disposed forces including those resulting from external forces acting upon said floating structure.

3. The construction as described in claim 1 wherein said mooring means comprises a rotatable element mounted to rotate about said fixed mooring point, and said means pivotally attaching said arms to said mooring means comprises a pair of universal joint structures associated respectively with said ends of said arms whereby said arms pivot independently of each other, and whereby said floating structure and said arms can swing around said fixed mooring point.

4. The construction as described in any of claims 1, 2 or 3 which includes means forming a continuous fixed fluid-flow path vertically within said column to a zone above said water level and thence through a movable interconnection adjacent said mooring means and onto said floating structure.

5. The construction as described in claim 3 wherein said rotatable element comprises a table structure rotatable around said fixed mooring point, and wherein said universal joint structures connect each of said arms to said table structure.

6. The construction as described in either of claims 1 or 3 which includes means providing a fixed fluid-flow path from below the water level to said mooring means, means forming a fixed fluid-flow path from adjacent said mooring means in a zone above said water level to adjacent said floating structure, means in said zone forming a movable fluid-flow path interconnecting said fixed fluid-flow paths, and means independent of said arms extending between said floating structure and said mooring point and providing support for the second-named of said means forming a fixed fluid-flow path.

7. The construction as described in either of claims 1 or 3, wherein the length of each of said arm can be either increased or decreased from said predetermined length.

8. The construction as described in either of claims 1 or 3, wherein each of said compensators is so constructed and arranged as to reduce surging and cyclic movement of said floating structure.

9. The construction as described in claim 1 wherein each of said compensators comprises a pair of piston and cylinder assemblies separate from said arms and one of which urges its arm assemblies toward said neutral predetermined intermediate length when said arms are extended from said predetermined length and the other of which urges said arms toward said neutral predetermined intermediate length when said arms are telescoped therefrom and means supplying fluid under pressure to the respective cylinders of the assemblies at a controlled rate.

10. The construction as described in claim 9 wherein said piston and cylinder assemblies are positioned in tandem with the same axis and with their pistons closing the adjacent ends of the cylinders, and which includes stop means limiting said pistons in their movement toward each other, and operating means for said pistons including piston rod means extending along said axis and means which is operative to move each of said pistons along its cylinder away from the other of said pistons without moving the other of said pistons.

11. The construction as described in claim 10 which includes an accumulator tank containing a body of liquid and a body of air under controlled pressure, liquid lines extending from said tank below the top level of said body of liquid to the remote ends of said cylinders and restricter means in said liquid lines which limits the rate of flow of liquid between said tank and said cylinders.

12. The construction as described in claim 2 wherein said means pivotally connecting the arms to said mooring means and said floating structure comprise universal joints connecting said arms respectively to said mooring means and said floating structure.

13. The construction as described in claim 2 which includes fluid-flow means providing a continuous fluid flow path from said column below the water level and thence to said floating structure.

14. The system as described in claim 13 which includes a central telescopic arm positioned between the above-mentioned diverging telescopic arms and which provides support for the portion of said fluid flow means extending from said axis to said floating structure.

15. The system as described in any of claims 2, 12 or 13 which includes means to limit the rate at which the lengths of said arms are changed to thereby dampen any tendency for vibration or relative cyclic movement of the respective portions of said arms.

16. In a system for mooring a floating structure offshore in water, the combination of, rigid means which is fixed to the sea bed and which projects upwardly therefrom, a single point mooring means mounted upon said rigid means above the water level and forming a vertical mooring axis, two telescopic arms each of which compresses two telescopic arm members, one of which is pivotally attached at one end to said mooring means independently of the other mooring arm for common swinging movement about said mooring axis with said mooring means, separate means for independently pivotally connecting the other end of each of said arms directly to a floating structure, said arms providing an articulated connection between said floating structure and said mooring means and permitting said floating structure to swing in response to external forces through an arc around said mooring axis without restricting the normal rotational and tri-axial motions of the floating structure, and two compensator means separate from and associated respectively with the telescopic arm members of said mooring arms and operative independently of each other for exerting compensating forces urging each of said arms toward a predetermined normal intermediate length between a maximum extended length and a minimum compressed length, while permitting each of said arm lengths to be increased or decreased therefrom by external forces tending to move said floating structure from a normal attitude with respect to said mooring means when said external forces are greater than the oppositely-directed forces of the compensator means, and with said compensating forces acting continuously in opposition to the actions of said external force to return said floating structure to said normal attitude when said floating structure has been moved therefrom, each of said compensator means comprising a hydraulic piston and cylinder assembly operatively connected between the arm members of the associated mooring arms.

17. The system as described in claim 16 which includes means to limit the rate at which the lengths of said arms are changed to thereby dampen any tendency for vibration or relative cyclic movemnt of the respective portions of said arms.

18. A single-point mooring system for a floating structure comprising, the combination of, a fixed column supported on the sea floor and projecting upwardly and including mooring means rotatably mounted upon a fixed mooring point axis above the water level, a pair of extensible mooring arms, each of which comprises a pair of telescopically arranged arm members and a predetermined normal intermediate length between a maximum extended length and a minimum compressed length and which may have its effective length change from said predetermined normal length without substantially impairing its structural stability, a pair of compensators separate from said arms operatively associated respectively with said mooring arms and respectively engaged between the arm members of their associated arms for urging its arm to said predetermined normal length while permitting its arm to change from said predetermined normal length against predetermined forces produced by the compensator means, means independently pivotally attaching one end of said arms to said mooring means whereby said one end of each arm rotates with said mooring means about said axis, and separate means independently pivotally connecting the other end of each of said arms directly to a floating structure at zones spaced a predetermined distance from each other, whereby said compensators act through said arms to urge said floating structure toward a desired neutral attitude with respect to said mooring point while permitting said floating structure to move from said desired neutral attitude against the action of predetermined forces, said compensator means returning said floating structure to said desired attitude when the forces moving said floating structure therefrom have been discontinued, and said floating structure being free to swing around said fixed mooring point irrespective of whether or not it is in said desired attitude but being urged continuously to said desired attitude by the action of said compensators; each of said compensator means comprising a pair of piston and cylinder assemblies one of which urges its arm assemblies toward said normal intermediate position when said arm assemblies are extended from its said predetermined length and the other of which urges said arm assemblies toward their respective predetermined normal lengths when said arm assemblies are telescoped therefrom;

means supply fluid under pressure to the respective cylinders of the assemblies at a controlled rate, said piston and cylinder assemblies being positioned in tandem with the same axis and with their pistons closing the adjacent ends of the cylinders, stop means limiting said pistons in their movement toward each other, operating means for said pistons including piston rod means extending along said axis and means for moving each of said pistons along its cylinder away from the other of said pistons without moving said other of said pistons, an accumulator tank containing a body of liquid and a body of air under controlled pressure, liquid lines extending from said tank below the top level of said body of liquid to the remote ends of said cylinders and a restricter valve in said liquid lines which limits the rate of flow of liquid between said rank and said cylinders.

* * * * *